United States Patent [19]

Ritter et al.

[11] Patent Number: 4,539,787

[45] Date of Patent: Sep. 10, 1985

[54] REINFORCEMENT MAT FOR REINFORCED CONCRETE

[75] Inventors: Gerhard Ritter; Klaus Ritter, both of Graz, Austria

[73] Assignee: AVI Alpenländische Veredelungs-Industrie Gesellschaft m.b.H., Graz, Austria

[21] Appl. No.: 442,149

[22] Filed: Nov. 16, 1982

[30] Foreign Application Priority Data

Nov. 20, 1981 [AT] Austria ..... 5003/81
Feb. 17, 1982 [AT] Austria ..... 608/82

[51] Int. Cl.[3] ..... E04C 2/42
[52] U.S. Cl. ..... 52/664; 52/600
[58] Field of Search ..... 52/660, 662, 664, 600, 52/719, 319, 414, 250, 378, 380

[56] References Cited

U.S. PATENT DOCUMENTS

| | | | |
|---|---|---|---|
| 3,302,360 | 2/1967 | Bjerking | 52/660 X |
| 3,914,915 | 10/1975 | Van Schyndel | 52/600 X |

FOREIGN PATENT DOCUMENTS

| | | | |
|---|---|---|---|
| 1246209 | 8/1967 | Fed. Rep. of Germany | 52/660 |
| 686206 | 7/1930 | France | 52/664 |
| 646020 | 4/1964 | France | 52/664 |
| 1369366 | 7/1964 | France | 52/660 |
| 413144 | 3/1946 | Italy | 52/600 |
| 282793 | 1/1965 | Netherlands | 52/660 |
| 428157 | 7/1967 | Switzerland | 52/660 |

*Primary Examiner*—Carl D. Friedman
*Assistant Examiner*—Naoko N. Slack
*Attorney, Agent, or Firm*—Ernest F. Marmorek

[57] ABSTRACT

A reinforcement mat for reinforced concrete consists of longitudinal wires and crosswires which are welded together at their points of cross. End portions of the crosswires project out beyond the edge longitudinal wires and are bent back in the plane of the mat towards the edge longitudinal wires. The longitudinal wires are arranged symmetrically about the longitudinal centerline of the mat partly at wider and partly at narrower pitch. At each edge of the mat a family of at least two longitudinal wires are provided at the narrower pitch.

15 Claims, 16 Drawing Figures

1b
3a
4a
4b
3b
2a
2b
1a 1b
3a
4a
13b
12b
2a
12a
4b
3b
13a
2b
1a 1b
2a
15b
3a
14b
4a
15a
14a
3b
4b
2b
1a

REINFORCEMENT MAT FOR REINFORCED CONCRETE

The invention refers to a reinforcement mat for reinforced concrete, consisting of longitudinal wires and crosswires which cross one another and are welded together at the points of cross and have their bonding improved by stamping or ribbing or in some other way.

In the case of reinforcement mats of this kind, known from West German No. A2-2 315 520 and West German No. A1-2 350 866, the end portions of the crosswires project at both sides of the mats beyond the edge longitudinal wires and, for improvement of the transmission of force to a neighbouring mat, they are bent back at each edge of the mat in the form of loops over the two outer longitudinal edge wires and again over further longitudinal wires and welded to them. The same effect of improved transmission of force in the direction of the crosswires might be achieved by extending the end portions of the crosswires overhanging beyond the edge of the mat and bending them back only as far as the edge longitudal wires. But in both cases the improvement of the transmission of force demands a considerable additional outlay in the material of the crosswires.

A further disadvantage of longer end portions of crosswire consists in the fact that, in the case of preservation of the width of mat from currently normal standard programmes, grid sheets having a large overhang of the crosswires can no longer be produced on grid welding machines which are found in use for the current standard programmes.

An improvement in the transmission of force from reinforcement mats in the transverse direction may be achieved in a manner, in itself known, by overlapping the edges of adjacent mats by at least one mesh width. In that case of course there is then lying in the region of the overlap of the mats not only twice as much crosswire material as would in itself be necessary for absorbing the forces but the longitudinal wires too lie respectively in pairs side by side, that is, one from each of the two mats which are overlapping one another, so that there occurs in the region of overlap an accumulation of material of the longitudinal wires.

Since reinforcement mats are produced in lengths, which are relatively long, but, having regard to handling as well as to transport on lorries and railway trucks, they are produced only in restricted widths, any reinforcement in the direction of the crosswires of the mats must in practice for adaptation to the different dimensions of the supporting structure which is to be reinforced, be composed of a number of mats laid side by side, whereby the waste of material as described accumulates in the regions of overlap.

The problem underlying the invention is to construct a reinforcement mat of the kind initially referred to, in such a way that, firstly, an optimum transmission of force is ensured between the crosswires of adjacent mats and secondly a reinforcement composed of mats in accordance with the invention may practically without waste of material be adapted within wide limits to different dimensions of the supporting structure in the direction of the crosswires of the mats.

The invention arises first of all from the already long known fact that a local increase in the carrying capacity of a flat supporting structure is effective not only in the direct region in which it is caused but is also effective up to a certain distance on both sides of this region (the so-called effective flange width). If, in a flat supporting structure, there is a higher cross sectional area of steel per unit width in one region that in the remaining regions of the supporting structure, then the regions of higher intensity of reinforcement take over part of the load from the regions of lower intensity of reinforcement. In practice that means that the reinforcement may be calculated at a value which corresponds with the mean value of the intensity of reinforcement of the strongly reinforced regions and of the more weakly reinforced regions.

Of this knowledge which, as already remarked, is in itself already old, no practical use has hitherto been made because the intended dimensions of overlap, which naturally must be specified on the plnes of laying, must be exactly maintained on site, which assumes a very careful and thereby time-wasting and uneconomic laying of the mats. But furthermore in the case of the reinforcement mats usual hitherto, in particular in the case of flat supporting structures reinforced along two axes, the start and end of a mat in the laid joining construction could be established only with great difficulty, so that subsequent checking of the manner of laying was almost impossible by the inspection engineer. There were therefore both doubts as regards the economy, in the case of the necessary exact laying, and also doubts as regards the safety of the structure, because of errors in laying which could not be checked, which made it appear advisable not to make use of the knowledge stated above.

The invention further arises from a second item of knowledge, that in the case of the inclusion of a number of points of weld in the range of transmission of force in a crosswire, the individual points of weld on the crosswire in question participate in the transmission of force to an extent which differs more greatly the greater the distance apart of the longitudinal wires. This applies in particular for ribbed wires or wires equipped in other ways with improved bonding characteristics, because these transmit into the concrete in a relatively short distance the forces prevailing in them, whereby of two successive points of weld the second becomes unloaded.

Only if the two edge longitudinal wires and thereby the two outermost points of weld of a crosswire at each edge of the mat have the smallest possible distance apart, can an approximately uniform distribution of load over the two points of weld therefore be achieved, so that even in the case of the construction of supporting splices, sufficiency may in general already be found with two points of weld in the region of overlap.

The problem of the present invention is now solved on the basis of the items of knowledge described, through the combination of the features that the crosswires project out beyond the edge longitudinal wires and the projecting end portions of the crosswires are bent back in the plane of the mat in the direction towards the edge longitudinal wires, and that the longitudinal wires are arranged symmetrically about the longitudinal centreline of the mat partly at wider and partly at narrower pitch, where at each edge of the mat a family of at least two longitudinal wires arranged at narrower pitch is provided.

Through the bending back of the end portions of the crosswires, which improves the transmission of force in the transverse direction, and the simultaneous narrow placing of preferably two longitudinal wires at each edge of the mat, which in general ensures the sharing of the load by at least the second longitudinal wire, the anchoring of the crosswires in the concrete is sufficiently improved. This is so even in the case that, through a manufacturing error or through subsequent damage of a mat, one of the two points of weld at the edge of the mat fails, for the projections of the crosswires can be made so short that grid mats in accordance with the invention may be produced in standard widths even by means of conventional grid welding machines.

Furthermore through this edge construction of the mat in accordance with the invention the sections of crosswire lying side by side in the region of overlap of adjacent mats, and thereby the waste of material of the crosswires, are reduced to a minimum.

Through the arrangement of longitudinal wires in the interior of the mat symmetrically about the longitudinal centreline of the mat partly at wider and partly at narrower pitch, markings are furthermore created for the laying of adjacent mats in overlap. The mats can thereby be laid on site quickly and thereby rationally without special auxiliary means, in such a way that they may easily be adapted to the intended dimensions of the supporting structure in the direction of the crosswires of the mats. The chosen form of lay always remains able to be easily checked, because the end portions of the crosswires bent back in the direction towards the edge longitudinal wires form in the finish-laid arrangement of the mats clearly recognisable irregularities, so that the stretch along which the edges of adjacent mats overlap always remains easily remeasurable.

In order to shorten the necessary extended length of the end portions of the crosswires which are bent back into loops and thus to save further material, the end portions of the crosswires at each edge of the mat may be bent back at least as far as the outermost longitudinal edge wire and welded to it.

In the case of heavily ribbed steel and steel having a heavily stamped surface the anchoring action of the surface of the wire is so good that welding to the edge longitudinal wires of the ends of crosswires which have been bent back as far as the edge longitudinal wires is not necessary statically. In these cases even L-shaped hooks are sufficient, which are bent down merely as far as a position in parallel with the longitudinal wires.

But preferably the projecting ends of the crosswires are bent back by a full 180° because the loops so obtained are, because of their section in the shape of a circular arc, considerably more clearly recognisable in the arrangement of the laid mats than hooks the two arms of which run essentially in parallel with the wires of the two families of wires. Moreover each end portion of crosswire which has been bent back towards an edge longitudinal wire is advantageously connected by at least one tack weld to the edge longitudinal wire in order to ensure that the loop does not get bent up during handling of the mat in transport and on site, whereby it would lose at least its function as a clear marking for the widths of overlap of adjacent mats.

In order to make the different mutual spacings of the longitudinal wires clearly distinguishable from one another, the narrow pitch of the edge longitudinal wires may be equal to or less than half the wider pitch of the longitudinal wires. Preferably the narrower pitch is chosen at about 50 mm. because in this case with the grid welding machines which are in current use, welding of the crosswire onto the two longitudinal wires arranged at this pitch is still possible by two separate electrodes. If one were to go down to a smaller spacing of the points of weld, then both points of weld would have to be fed from a common electrode. That would mean that the welds of the crosswire to two longitudinal wires arranged at narrower pitch would, at equal electrode feed, turn out weaker than the welds of the same crosswire to the longitudinal wires arranged at wider pitch, which obviously would run counter to the sense of the invention.

The invention, as is described later in greater detail, allows the production of mats which, in the case of the laying of mats in overlap, open up the possibility of taking into account the accumulations of steel in the regions of overlap as uniformly distributed; and of mats which, in the case of a predetermined width of mat, enable, by a corresponding choice of the pitches of the longitudinal wires, production on easily adjustable and readjustable multispot grid welding machines having a predetermined equidistant arrangement of the electrodes; as well as mats which, through an edge saving effect, allow, even in the case of mats of great width, laid with a small overlap, a largely uniform specific cross-section of steel.

The invention is explained in greater detail below by reference to the drawings of examples of mats in accordance with the invention. In the drawings.

Figure 1:
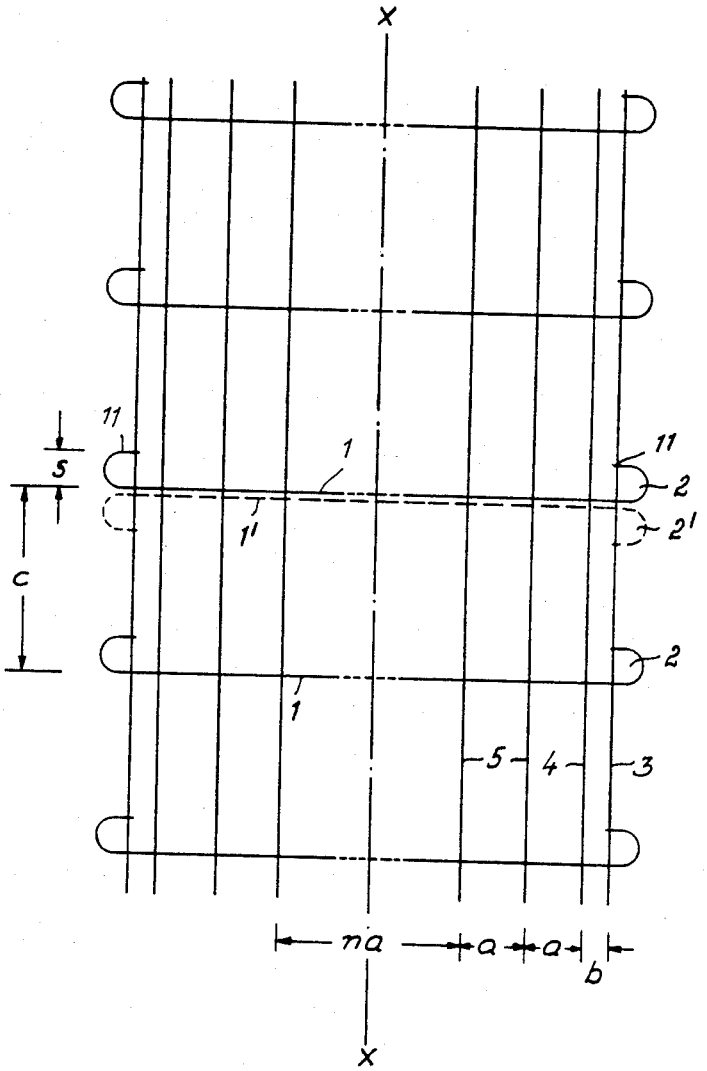
FIGS. 1 to 6 show various mats in accordance with the invention, in plan.

In FIG. 1 there is seen a mat with longitudinal wires 5 in the inner region of the mat and longitudinal wires 3,4 in the two edge regions. The longitudinal wires in the inner region are arranged at equal pitch a. For the purpose of simplification the mat is not drawn in full, on the contrary n-1 longitudinal wires are respectively omitted in the inner region, which has been indicated by the specification of pitch "n.a" in the region of the axis of symmetry of the mat.

The two longitudinal edge wires 3,4 are arranged at a pitch b which is considerably smaller than the pitch a of the remaining longitudinal wires and amounts preferably to between about 20 and 50 mm.

The crosswires 1 are likewise arranged at equal pitch c which is, however, as a rule greater than the pitch a of the inner longitudinal wires. The end portions 2 of the crosswires 1 are at each edge of the mat and symmetrically with respect to the centreline X—X of the mat, bent back into loops and welded at 11 to the outermost longitudinal edge wire 3. But the loops may also be carried as far as the second longitudinal edge wire 4 and welded only to this or to both longitudinal edge wires 3,4.

If in the case of mats as in FIG. 1, the unobstructed pitch distance c between adajcent crosswires 1 is greater than twice the amount of the outside dimension s, measured in the direction of the longitudinal wires 5, of the loops 2 formed by the bent back end portions of the crosswires, the mats may be stacked to save space in positions turned alternately by 180°. This is because then, as indicated in FIG. 1 by dotted lines, each crosswire 1' of the turned mat comes to lie in one plane beside a crosswire 1 of the mat which has not been turned, and the loops 2' of the crosswire 1' of the turned mat find room between a crosswire 1 and the loops 2 of the adjacent crosswire of the unturned mat.

Figure 2:
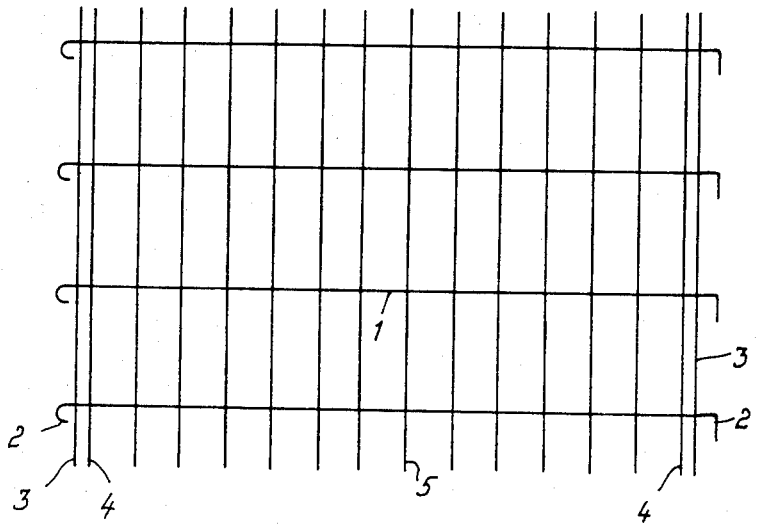

In accordance with the example as in FIG. 2 the end portions 2 of the crosswire 1 may also be bent back in the form of round hooks (left-hand edge of the mat) or of sharply angularly L-hooks (right-hand edge of the mat) in the direction towards the edge longitudinal wires 3 and not welded to the latter.

Figure 3:
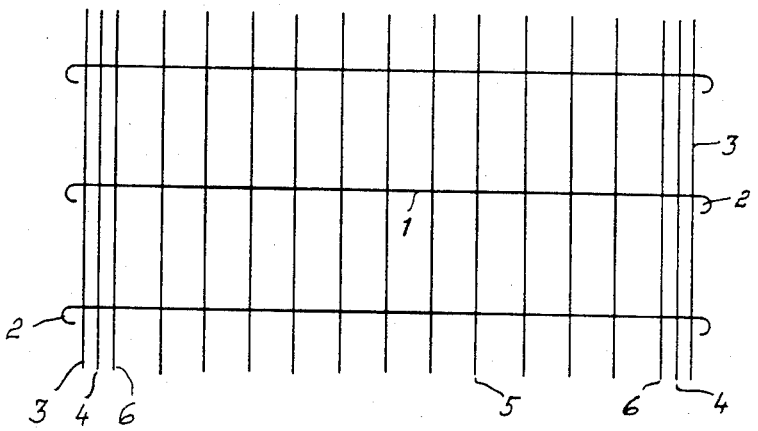

FIG. 3 shows a mat which exhibits a construction similar to that in FIG. 2, in which, however, a further longitudinal wire 6 is provided at each edge of the mat at a short distance from the longitudinal wire 4. Thus in the case of mats as in FIG. 3 there is at each edge of the mat a family of three longitudinal wires arranged at narrower pitch. A mat built up in that way will preferably be chosen when the bonding characteristics of the crosswires are inadequate for the anchoring together with only two points of weld, say, because for reasons of a particularly high breaking elongation having been demanded, the surfaces of the crosswires exhibit only moderate ribbing or stamping. Through the arrangement of three closely adjacent points of weld near the end of each crosswire bent round in the shape of a loop, the necessary transmission of force out of the crosswire into the concrete and via this into the crosswire of a neighbouring mat is ensured.

Figure 4:
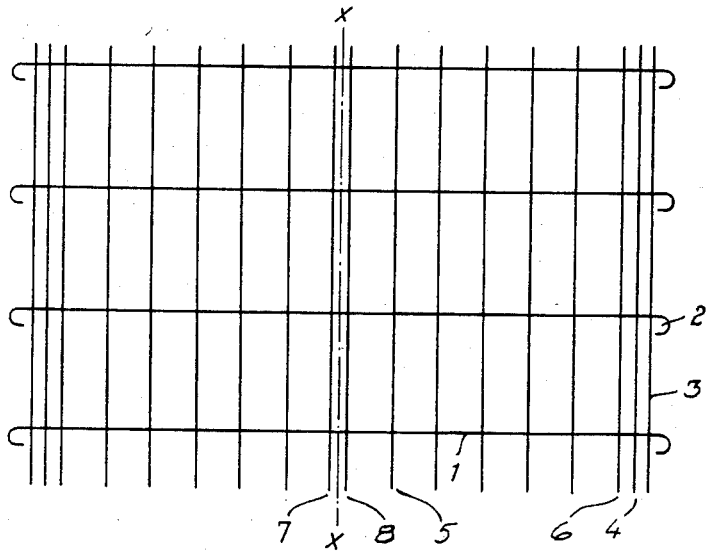

FIG. 4 shows a mat the construction of which differs from that of the mat as in FIG. 3 only in that two longitudinal wires 7 and 8 are provided on opposite sides of the longitudinal centreline X—X of the mat, which have a short distance apart. Mats built up in that way may be severed between the two wires 7 and 8, so that because of their symmetry two equal mats of half width result. Through this measure it becomes possible to adapt to different widths of supporting structure to a considerably further extent than is the case with mats according to FIGS. 1 to 3. The fact that mats halved in that way exhibit bent down end portions of crosswire 2 merely on one side, is not troublesome because the half mat can always be laid so close to the abutment of a flat supporting structure that one of the longitudinal wires 7 or 8 is lying directly on the abutment. This is sufficient for anchoring the mat onto the abutment in the concrete, because the bending moment in the supporting structure and thereby the tensions in the steel on the abutment are practically zero. The side of the half mat provided with bent down end portions of crosswire 2 is then lying turned towards the middle of the slab and thereby towards an adjacent mat and serves in the way in accordance with the invention for the transmission of force between the crosswires of adjacent mats.

It may be mentioned as a precaution that the pitch of the longitudinal wires 7 and 8 does not absolutely have to be equal to the pitch of the longitudinal wires 3,4 and 5 from one another, because in the case of the arrangement of the wires 7 and 8 it is a question of the creation of a point of separation and not of a measure for better anchoring of the crosswires.

Figure 5:
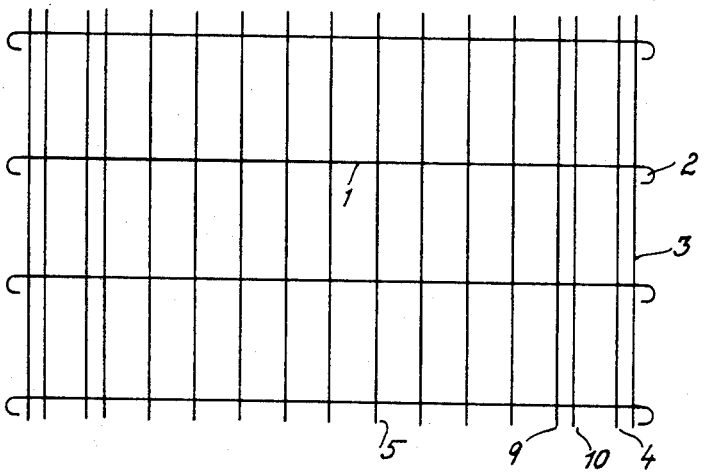

FIG. 5 shows a mat similar to that as FIG. 2 in which, however, adjacent to the family provided at each edge of the mat, of longitudinal wires 3,4 arranged at narrow pitch, there is provided a further family of longitudinal wires 9,10 arranged at narrow pitch, where the inner longitudinal wire 4 of the family of longitudinal wires 3,4 arranged at the edge of the mat and the outer longitudinal wire 10 of the further family of longitudinal wires 9,10 next to it have a wide distance apart.

Mats of that kind may be laid in such a way that the longitudinal wires 4 of two adjacent mats come to lie respectively side by side. But they may also be so laid that the longitudinal wire 4 of the one mat comes to lie in each case beside the longitudinal wire 9 of the neighbouring mat, in which case the width of slab covered by the two mats is then less than in the case of the form of lay so first mentioned. These mats, therefore within certain limits, allow adaptation to different widths of a structural member which is to be reinforced.

Figure 6:
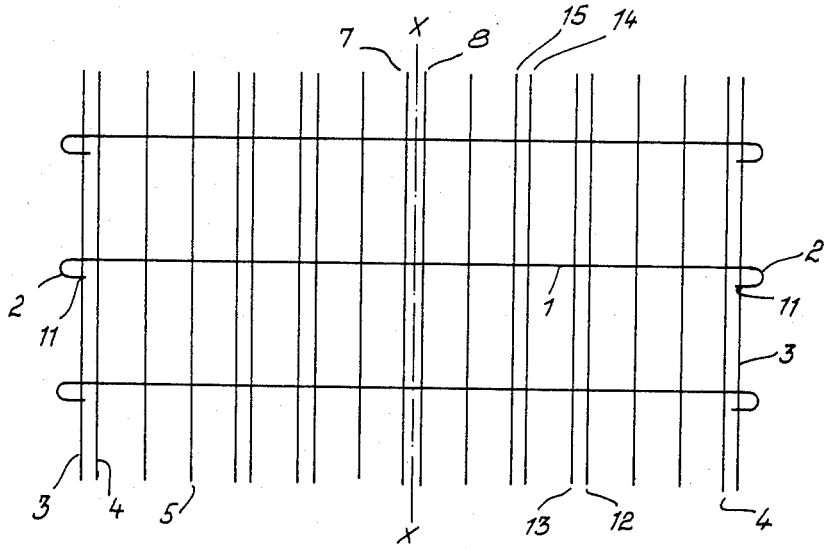

One special form of mat in accordance with the invention is shown in FIG. 6. This mat in which the end portions of crosswire 2 are carried back, for example, as far as the edge longitudinal wires 3 and may be connected to the latter at 11 by tack welds, exhibits in addition to two longitudinal wires 7,8 arranged on opposite sides of the longitudinal centreline X—X to create a point of separation, another two families of respectively two longitudinal wires 12,13 and 14,15 arranged at narrower pitch. The longitudinal wires 12,13 lie approximately at one quarter of the way across the width of the mat, the longitudinal wires 14,15 approximately at one third of the way across the width of the mat.

As may be seen from FIGS. 7 to 12, mats of that kind may by a suitable choice of the form of lay be adapted in small stages within very wide limits to different dimensions of supporting structure.

For distinguishing them in FIGS. 7 to 12 the reference numbers of all of the parts of one mat are provided with the letter "a", those of all of the parts of the other mat with the letter "b".

Figures 7, 8, 9:
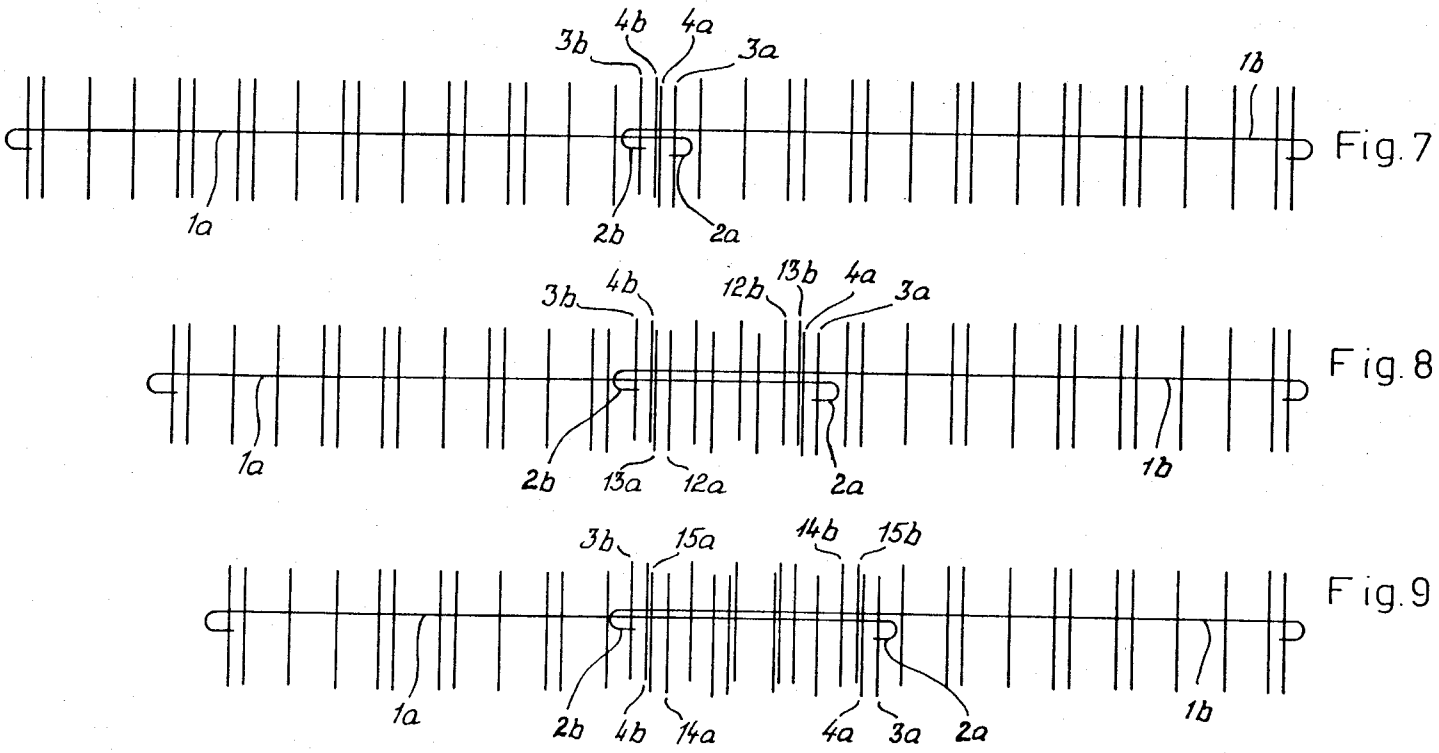
FIGS. 7 to 12 show different ways of laying of mats as in FIG. 6, in plan.

In accordance with FIG. 7 the two mats are so laid that the longitudinal wires *4a, 4b* of the edge families of longitudinal wires *3a,4a* and *3b,4b* respectively, arranged at narrow pitch, are touching one another. In the case of this form of lay the mats cover the widest possible width of slab. The edges of both mats next to one another remain clearly recognisable through the end portions *2a,2b* of crosswire bent round in the shape of loops.

In the case of the form of lay in accordance with FIG. 8 the longitudinal wires *4a,4b* lie beside the longitudinal wires *13b,13a*. The two mats now overlap one another by about one quarter of their width, so that the area reinforced by the mats have become narrower than in the case of FIG. 7. But at the same time in comparison with the case as in FIG. 7 an increased specific cross-sectional area of steel may be taken into account so that practically no waste of material occurs.

A further form of lay is shown in FIG. 9, in accordance with which the longitudinal wires *4a,4b* now come to lie beside the longitudinal wires *15a,15a*. In the case of this form of lay the mats overlap one another by $\frac{1}{3}$ of their width and therefore cover a still narrower section of the supporting structure. Here too the end portions *2a,2b* of crosswire bent down in the form of loops may be clearly recognised, by means of which even in the laid joining construction of the mats the boundaries of the individual mats remain recognisable.

Figure 10:
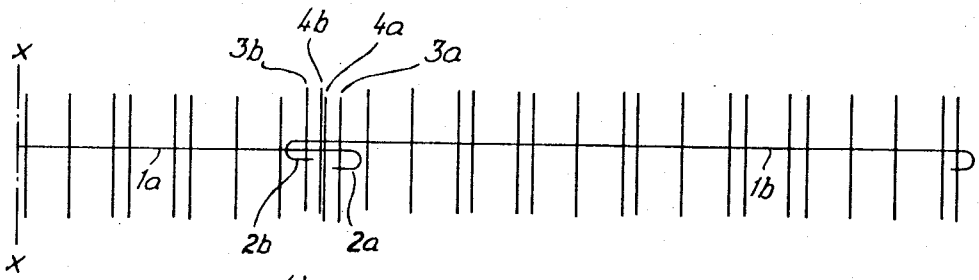
Figure 11:
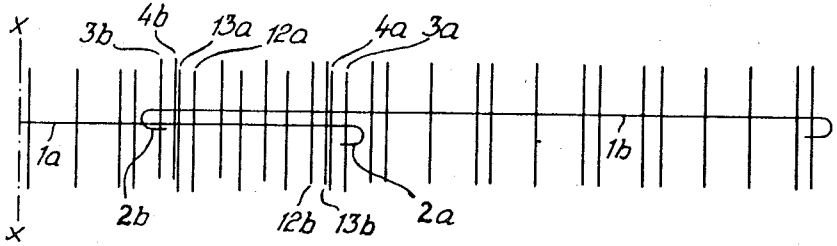
Figure 12:
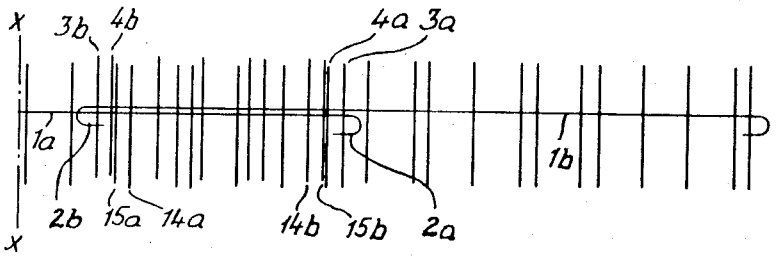

In FIGS. 10 to 12 the forms of lay as FIGS. 7 to 9 are repeated, but in this case the left-hand mat has been severed along its axis of symmetry X—X. Hence in accordance with FIG. 12 the mats laid in the way there shown cover a width of supporting structure which is still only slightly greater than that which may be covered by a single mat.

Figure 13:
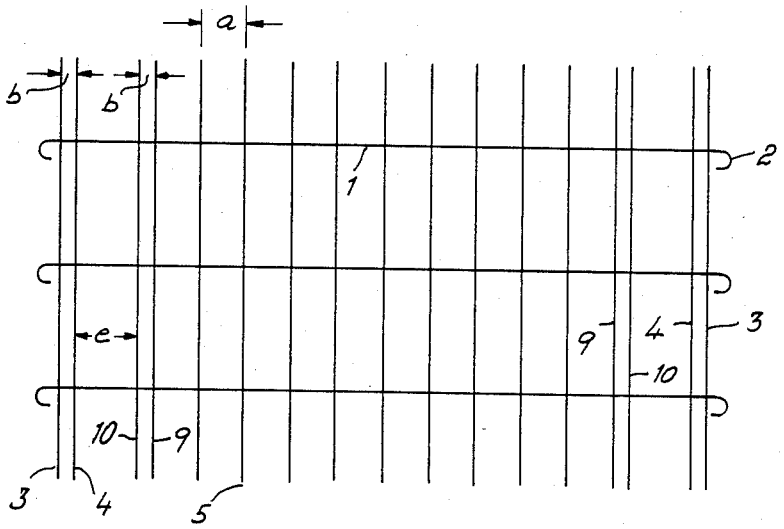
FIGS 13 to 14 show two further mats in accordance with the invention, in plan; and, FIGS. 15 and 16 show two further mats in accordance with the invention in cross-section.

The mat shown in FIG. 13 is largely similar to that shown in FIG. 5. Since it is not possible to build up arbitrary widths of mat in each case with as far as possible whole numbers of narrower and wider pitches between the wires in such a way that the wider pitches between the wires are always also equal wholenumber multiples of the narrower pitches between the wires, but the standard widths of mat employed in the separate countries are chosen on the basis of very different points of view, it may be advantageous to separate the two families 3,4 and 9,10 of longitudinal wires arranged at narrower pitch b, arranged at each edge of the mat as shown in FIG. 13, from one another by a distance e which is greater than the pitch a of the longitudinal wires 5 in the inner region of the mat.

If it is assumed, for example, that the standard width of mat amounts to 2,400 mm. (as is the case at present in Austria), the end portions of crosswire 2 bent round in the shape of loops overhang beyond the edge longitudinal wire 3 by 50 mm., the narrower pitch b between the longitudinal wires 3 and 4 and respectively 9 and 10 likewise amounts to 50 mm. and the pitch a between the inner longitudinal wires 5 amounts respectively to 150 mm., then a mat can be built up with intervals of $6\times50=300$ mm. and $14\times150=2{,}100$ mm., that is altogether a width of 2,400 mm. Then in the case of this mat the longitudinal wires 4 and 10 have a mutual spacing of 150 mm. and the mat corresponds with that shown in FIG. 5.

But if the mats must be 2,050 mm. wide as is usual, for example, in Switzerland, then a build-up of mats with narrow pitches b of always 50 mm. and wide pitches a of always 150 mm. is no longer possible. In this case, between the longitudinal wires 3,4 and 9,10 a distance b of 50 mm. may be provided and likewise for the loops an edge overhang of 50 mm. The distance e between the longitudinal wires 4 and 10 may amount to 200 mm. and finally in the interior of the mat eight longitudinal wires 5 may be arranged at a spacing of 150 mm. each. Then together an overall width of $6\times50+2\times200+9\times150=2{,}050$ mm. results.

Figure 14:
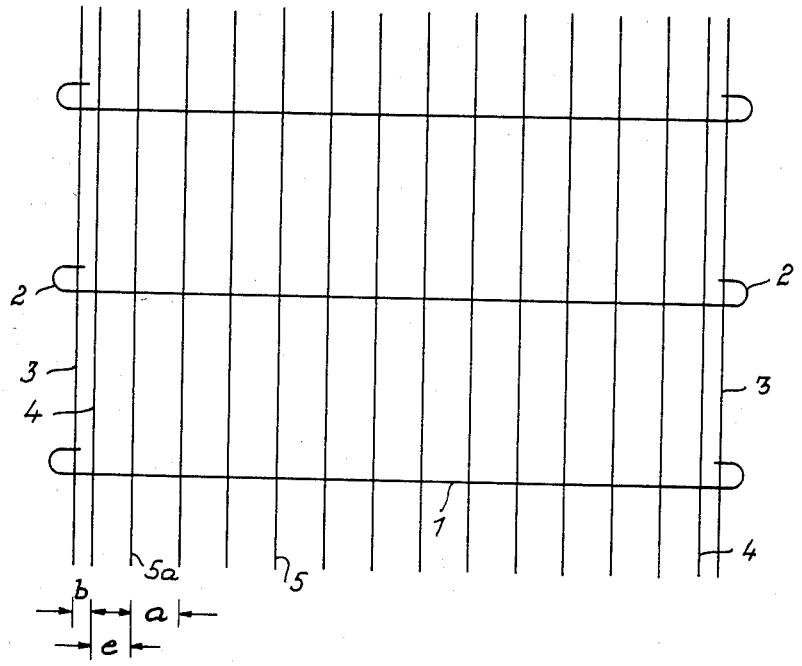

In general, account may be taken of the desire, for reasons of economy in the transport of the mats, to produce all of the mats of the permitted maximum width, if in accordance with FIG. 14 the longitudinal wires 5 in the inner region of the mats (apart from the longitudinal wires 7,8 in the centre of the mats, provided if necessary in accordance with FIG. 4 for facilitation of dividing up the mat) are arranged at equal pitch a and near each edge of the mat two longitudinal wires 4,5*a* are arranged at a pitch e which is greater than the pitch b of the edge longitudinal wires 3,4 and deviates from the pitch a of the longitudinal wires 5 in the inner region of the mats.

Figure 15:
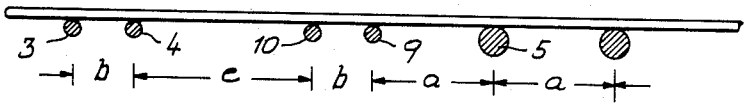

In the case of mats as in FIG. 5, in which two families 3,4 and 9,10 of longitudinal wires arranged at narrower pitch b are provided at each edge of the mat, this teaching, as the cross-section according to FIG. 15 also reveals, is fulfilled because the longitudinal wires 4 and 10 of these two families of wires, which are adjacent to one another, have the distance e apart, which is greater than the pitch b of the edge longitudinal wires and also greater than the spacing a of the longitudinal wires in the inner region of the mat.

Figure 16:
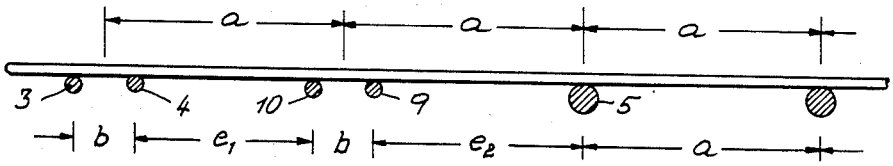

A similar mat results according to FIG. 16 if the distance $e_1$ between the adjacent longitudinal wires 4 and 10 of the two families of longitudinal wires 3,4 and 9,10 and the distance $e_2$ between the inner longitudinal wire 9 of the inner family of longitudinal wires 9,10 and the longitudinal wire 5 adjacent to it in the inner region of the mat are different from one another.

Through this measure as well as through a further refinement of the invention explained with the aid of FIG. 15 and 16, better uniformity of the specific cross-section of steel in the joining construction of mats laid in overlap may also be achieved.

In the case of the laying of wide mats in overlap, the local accumulations of steel caused by the edge overlaps are usually allowed according to national rules to be taken into account as uniformly distributed only when the edge regions of adjacent mats overlap so far that the distance of the left-hand boundary of the reion of overlap at the right-hand edge of one mat from the right-hand boundary of the region of overlap at the left-hand edge of the same mat is equal to or less than a prescribed limiting value. But in all those cases in which the edges of adjacent mats overlap to a less exaggerated extent, the surplus of steel would be wasted in the region of the overlap.

That can be obviated within the scope of the invention if, advantageously, at least the diameter of the wires of the family of longitudinal edge wires 3,4, (but in accordance with FIGS. 15 and 16 also the diameter of the wires of a second family 9,10 of longitudinal wires 9,10 arranged at the narrower pitch b, which are adjacent to the family of wires 3,4) are chosen to be smaller than the diameter of the longitudinal wires 5 in the inner region of the mat. By this measure the specific cross-sectional area of steel at the edge of the mat on the individual mat is reduced.

For the same purpose, in the way already explained, either on its own or together with the reduction in the cross-sections of wire at the edge of the mat, the distance e of the wire 4 from the wire 10 and if necessary also the distance of the wire 9 from the wire 5 adjacent to it in the inner region of the mat, may also be increased. In the case of most mats, at least in the case of those in which the diameter of the individual wires is greater than the minimum diameter which must in any case be maintained for reasons of safety against rusting, by these measures, the specific cross-sectional area of steel at the edge of a mat may be reduced to the extent that in the case of the overlapping of two adjacent mats in such a way that merely the wires 3,4 of their edge wire families overlap, an at least approximately uniform distribution of the specific cross-section of steel results over the whole reinforced area, which is equal to the specific cross-section of steel in the inner region of the mat. In this case of overlap, therefore, no steel becomes wasted when the regions of the mats overlapping one another are removed too far from one another to allow a possible accumulation of steel to be added in, because the wires lying doubled in the region of overlap complement one another up to the same specific cross-section of steel as exists in the inner region of the mat.

In the case of further overlapping of the mats by several meshes, as long as the distance apart of the zones of overlap is greater than the limiting value which is stipulated to be included in ones calculations, wastage of steel certainly occurs yet always remains less than when all of the wires have equal diameters and equal pitch.

We claim:

1. In a reinforcement mat for reinforced concrete, said mat consisting of longitudinal wires and crosswires which cross one another and are welded together at the points of cross and have their bonding improved by ribbing or stamping, the improvement wherein end portions of said crosswires project beyond edge ones of said longitudinal wires and said projecting end portions of said crosswires are bent back in the plane of said mat in the direction towards said edge longitudinal wires; and wherein said longitudinal wires are arranged symmetrically about a longitudinal centreline of said mat partly at wider and partly at narrower pitch, and at each edge of said mat a family of at least two of said longitudinal wires arrangjed at narrow pitch is provided.

2. A reinforcement mat as in claim 1, wherein said projecting end portions of said crosswires at each edge of the mat are bent back in the shape of a loop at least as far as an outermost of said family of longitudinal wires arranged at narrower pitch and welded to at least one of said longitudinal edge wires.

3. A reinforcement mat as in claim 2, wherein the pitch of said crosswires is greater than twice the outside diameter of said loops, measured in the direction of said longitudinal wires.

4. A reinforcement mat as in claim 1, wherein said narrower pitch of said edge longitudinal wires is at most equal to half said wider pitch.

5. A reinforcement mat as in claim 1, wherein at least the preponderant part of said longitudinal wires lying in an inner region of said mat has a wider pitch than said edge longitudinal wires.

6. A reinforcement mat as in claim 5, wherein said longitudinal wires in said inner region of the mat are arranged at equal pitch and wherein near each edge of said mat two of said longitudinal wires have a pitch which is wider than the pitch of said edge longitudinal wires and differs from the pitch of said longitudinal wires in said inner region of the mat.

7. A reinforcement mat as in claim 1, wherein two longitudinal wires adjacent to the longitudinal centreline of said mat are arranged at said narrower pitch.

8. A reinforcement mat as in claim 1, wherein, adjacent to said family of longitudinal wires arranged at narrower pitch and provided at each edge of said mat, there is at least one further family of said longitudinal wires arranged at narrower pitch; the inner longitudinal wire of said family of longitudinal wires arranged at said edge of the mat and the outer longitudinal wire of said further family of longitudinal wires being at a greater distance apart.

9. A reinforcement mat as in claim 8, wherein said longitudinal wires which are adjacent to one another in said two families of longitudinal wires arranged at narrower pitch and provided at each edge of said mat, have from one another, and the inner longitudinal wire of said inner family of longitudinal wires has from the longitudinal wire adjacent to it in said inner region of the mat, each a distance which is greater than the pitch of said longitudinal wires in said inner region of the mat.

10. A reinforcement mat as in claim 9, wherein the distance between the adjacent longitudinal wires of said two families of longitudinal wires and the distance between the inner longitudinal wire of said inner family of longitudinal wires and the longitudinal wire adjacent to it in said inner region of the mat are different from one another.

11. A reinforcement mat as in claim 8, wherein the distance between the two longitudinal wires which are next to one another in said two families of longitudinal wires which are adjacent at each edge of the mat, is greater than the pitch of the preponderant number of said longitudinal wires in said inner region of said mat.

12. A reinforcement mat as in claim 8, wherein both said edge longitudinal wires and also the adjacent pair of said longitudinal wires have a smaller diameter than the remaining said longitudinal wires.

13. A reinforcement mat as in claim 1, wherein families of said longitudinal wires arranged at narrower pitch are provided at the edges of said mat and at least approximately in the region of one quarter to one third of the way across the width of said mat.

14. A reinforcement mat as in claim 1, wherein said end portions of said crosswires, projecting beyond the outermost longitudinal wires, are in the plane of the mat, bent in an angular shape.

15. A reinforcement mat as in claim 1, wherein said edge longitudinal wires have a smaller diameter than the remaining said longitudinal wires.

* * * * *